United States Patent [19]

Pozzi

[11] 4,301,860

[45] Nov. 24, 1981

[54] ROTARY DRUM HEAT EXCHANGER

[75] Inventor: Leopoldo Pozzi, Milan, Italy

[73] Assignee: Costruzioni Meccaniche Leopoldo Pozzi S.p.A., Italy

[21] Appl. No.: 121,056

[22] Filed: Feb. 13, 1980

[30] Foreign Application Priority Data

Oct. 15, 1979 [IT] Italy ..... 26508 A/79

[51] Int. Cl.[3] ..... F28D 11/02; F28F 5/00

[52] U.S. Cl. ..... 165/90; 165/92

[58] Field of Search ..... 165/90, 87, 89, 91, 165/88, 92, 93

[56] References Cited

U.S. PATENT DOCUMENTS

| | | | |
|---|---|---|---|
| 1,030,203 | 6/1912 | Paulsen | 165/88 |
| 1,746,497 | 2/1930 | Quensel et al. | 165/92 |
| 3,800,865 | 4/1974 | Onarheim et al. | 165/92 |

FOREIGN PATENT DOCUMENTS

| | | | |
|---|---|---|---|
| 581817 | 12/1924 | France | 165/90 |

*Primary Examiner*—Sheldon J. Richter

*Attorney, Agent, or Firm*—Ostrolenk, Faber, Gerb & Soffen

[57] ABSTRACT

A heat exchanger is disclosed, comprising a shell housing a rotor. The rotor comprises a series of hollow bodies whose interiors are hydraulically connected to each other and which are secured to a shaft which is rotatably mounted in the shell. One liquid flows through the shell in contact with the exterior of the hollow bodies. Part of the shaft is hollow to permit flow through the shaft and the hollow bodies of a second liquid. Diaphragms are disposed in the hollow bodies to regulate the flow of fluid therethrough. The shell preferably comprises large diameter fittings. The second liquid is preferably dense and may comprise sludge, waste water, etc.

22 Claims, 3 Drawing Figures

ROTARY DRUM HEAT EXCHANGER

BACKGROUND AND SUMMARY OF THE INVENTION

This invention relates to a rotating drum type heat exchanger. The object of the invention is to provide a heat exchanger able to recover the residual heat in waste fluids of any nature and origin, in particular sludge, waste water, etc., containing solids in suspension, such as discharge waters from chemical processors in general, particularly bleaching and dyeing plants, etc.

A further object of the invention is to provide a heat exchanger of this type that permits, under any operating conditions, a continuous and efficient heat exchange between the two fluids as a function of temperature, and also permits easy accessibility to the different parts of the heat exchanger itself (especially to the parts handling sludge and/or waste water) for periodic cleaning, maintenance, etc.

The heat exchanger according to this invention embodies a shell provided with fittings for inlet and discharge of the fluids to be treated. At least one rotor is rotatably housed in said shell and consists of a series of hollow bodies provided with internal diaphragms to regulate the flow of the other liquid under treatment. These hollow bodies are connected hydraulically to each other in succession, and their ends are joined with adequate fittings by means of rotary seals in order to permit circulation in counter-current of the other liquids under treatment in the rotor.

In one preferred embodiment of the heat exchangers of the of the invention, the shell (which rotatably houses at least one rotor) is provided with perforated supporting gudgeons at its opposite ends. The gudgeons connect the chambers of the hollow bodies with the exterior, and are held by supports connected movably to the side walls of the shell. The openings in the gudgeons are hydraulically interconnected by means of the sealing devices in the fixed gudgeons, which are in turn fastened to a base structure by means of supports which permit convenient rotation of the rotor and capsizing of the shell for cleaning and maintenance of the different parts of the heat exchanger.

The invention will now be described in detail in conjunction with the drawings, which illustrate by way of example only one preferred embodiment of the heat exchanger according to the invention, used mainly (but not exclusively) for heat recovery from waste waters.

DETAILED DESCRIPTION OF THE PREFERRED EMBODIMENT

Figure 1:
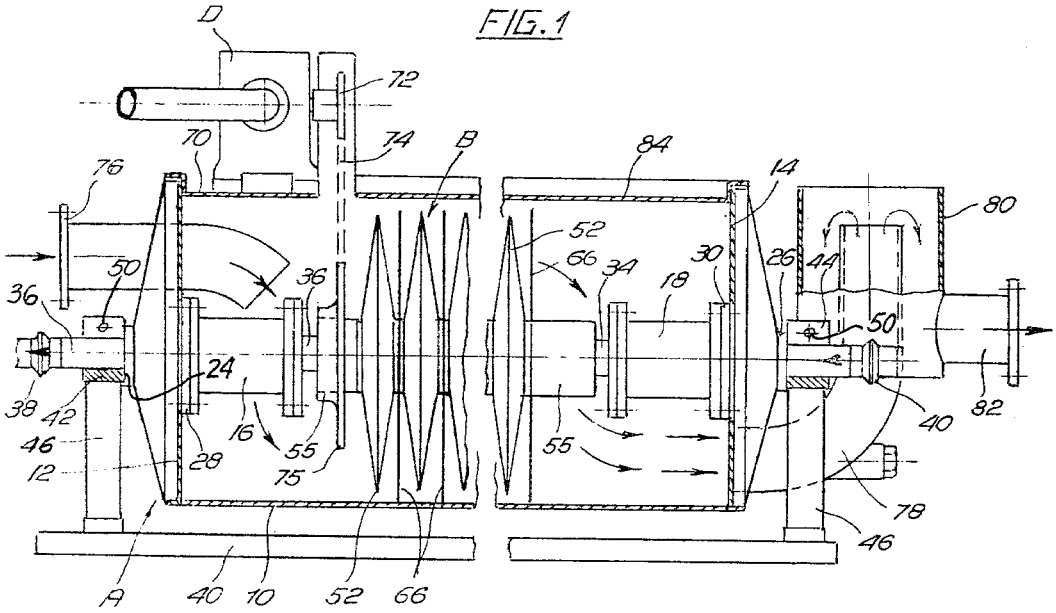
FIG. 1 is a front view in cross section of the heat exchanger of the invention.
Figure 2:
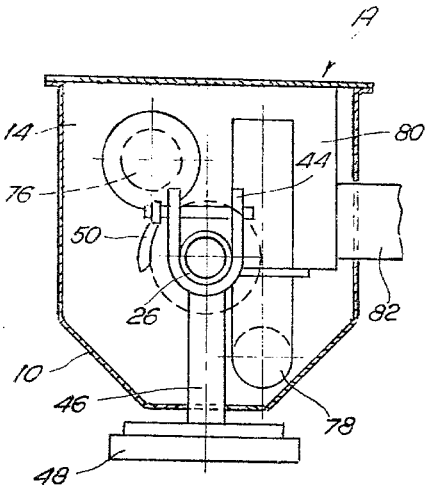
FIG. 2 is a view of the end of the heat exchanger of FIG. 1.

The heat exchanger illustrated in the drawings comprises a Shell A, in which one of the two fluids under treatment is caused to circulate. The shell A houses, rotatably, one or more drums or rotors B in which a second liquid under treatment circulates in counter-current.

Figure 3:
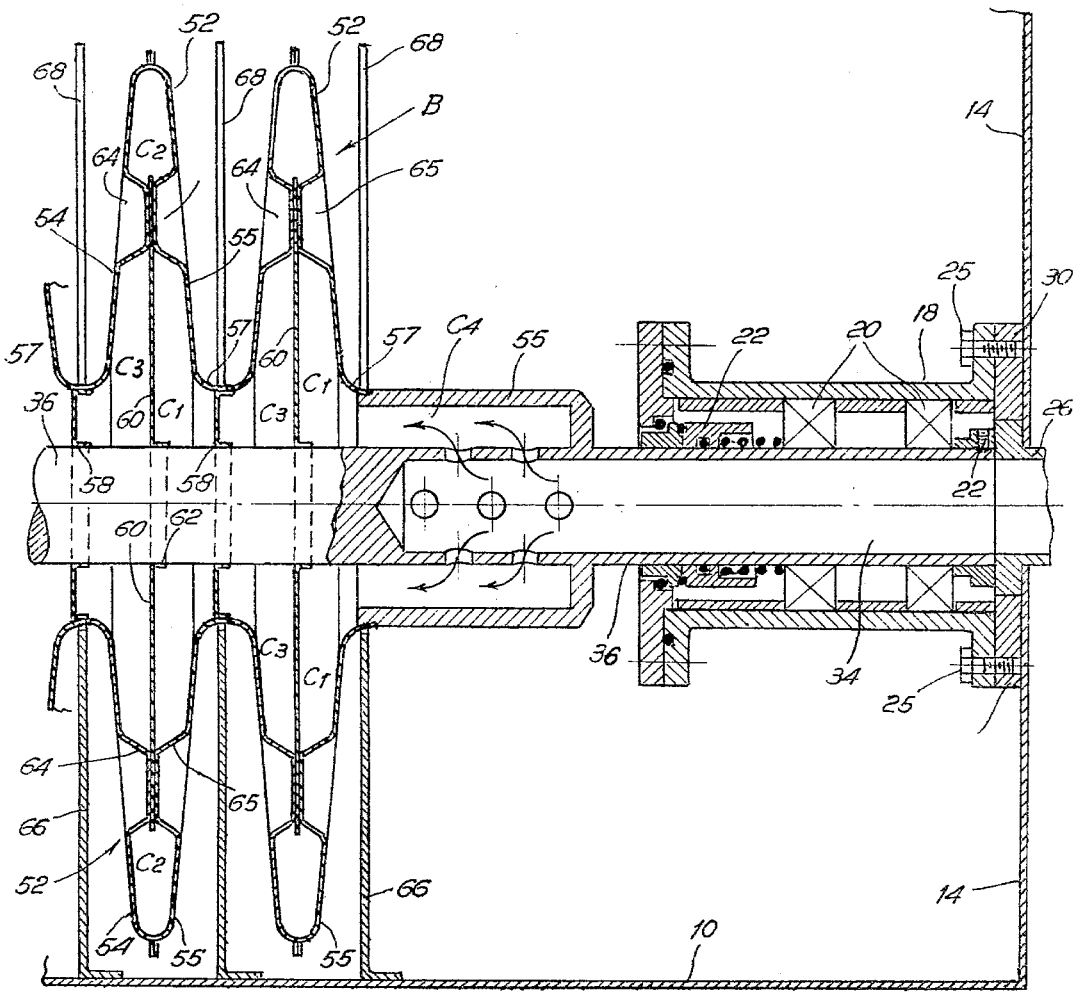
FIG. 3 is an axial cross-section of the right hand end of the heat exchanger shown in FIG. 1.

In the depicted embodiments shell A includes a substantially parallelipiped shaped vessel 10, the opposite end walls 12 and 14 of which are suitably reinforced and provided with respective supports 16 and 18 in their central part, which supports project toward the interior of the vessel 10 itself. Each one of supports 16 and 18 is operationally associated with roller bearings 20 (see FIG. 3) of rotary sealing elements 22 for tubular gudgeons 24 and 26 projecting longitudinally or axially outward from end walls 12 and 14 of the vessel 10. The inside ends of the gudgeons 24 and 26 terminate with flanges 28 and 30, secured to gudgeons 24 and 26 and also to the walls 12 and 14 of vessel 10. Moreover, flanges 28 and 30 are suitably perforated to receive screws 25 which secure said supports 16 and 18 to walls 12 and 14 of the vessel 10. The ends of the gudgeons 24 and 26 are connected hydraulically via rotary seals 22 to the hollow ends 32 and 34 of a shaft 36 carrying rotors B. The end surfaces of shaft 36 are flush with the longitudinally inward surface of flanges 28 and 30, respectively, to permit removal of rotor B from shell A, if necessary.

It follows that rotor B is rotatably supported in shell A and connected hydraulically to the exterior via removable fittings 38 and 40 in the free ends of tubular gudgeons 24 and 26, to connect gudgeons 24 and 26 with the pipes carrying the second of the two liquids under treatment.Tubular gudgeons 24 and 26 are secured to brackets 42 and 44, respectively. The brackets 42 and 44 are located at the top of stanchions 46, the latter being in turn anchored to base plate 48. A latching device 50 is supported by each bracket. A part of the brackets permit removal of shell A from its associated base plate 48, while the remaining parts engage the side end walls 12–14 of the shell A and hold this in working position (as shown on the drawings) or in the capsized or overturned position to which the shell A can be rotated around gudgeons 24 and 26 to permit cleaning of vessel 10.

It will be clear from the above-description that shell A can be locked in the working position by means of a single set of latches 50 which could consist, for example, of devices adequate to secure the arms of brackets 42 and 44 to each other and hence also gudgeons 24 and 26.

Shaft 36 of rotor B securely holds a plurality of lenticular shaped hollow bodies 52 arranged coaxially on shaft 36 and adjacent to each other. These lenticular bodies 52 each consist of two concave covers or caps 54 and 55 (see FIG. 3) whose edges are joined, for example, by welding.

The centers of the covers or caps 54 and 55 perforated, and edges 56 and 57 of the perforations are oriented in opposite directions to engage, head to head (and in seal tight relation) edges 57 and 56 respectively, of adjacent hollow bodies 52. Said hollow bodies 52 are in turn secured to shaft 36 by two sets of perforated diaphragms 58 and 60 interposed between the hollow bodies 52. Specifically: the first annular diaphragm 58 is formed by rings with edges folded over to partially engage said shaft 36; the remaining folded edges 56 and 57 of two adjacent bodies 52 are joined to each other, for example by the welding of two contiguous hollow bodies 52, whilst the intermediate walls of rings forming diaphragm 58 are perforated.

Annular diaphragms 60, on the other hand, consist of perforated discs extending from shaft 36 into the interior of hollow bodies 52; The folder inner edges 62 of these perforated discs engage shaft 36. The radially outer zones of said discs, on the other hand, are secured and locked in place, for example by welding, between the internal opposite faces of indentations 64 and 65, which project into the interior of hollow body 52. Ridges 64 and 65 are suitably spaced with respect to each other to provide a set of three communicating chambers $C_1$, $C_2$ and $C_3$ inside each hollow body 52. Edges 56 and 57 of the longitudinally outermost of hollow bodies 52 are joined by welding to caps 55. The bottom parts of caps 55 are perforated to permit insertion of hollow ends 32 and 34 of shaft 36. The hollow end portions 32 and 34 of the shaft 36 are also provided with perforations, radially, to allow communication between annular chambers $C_4$ in the caps 55 and chambers $C_1$–$C_3$ bodies 52. The presence of diaphragms 58 and 60 inside hollow bodies 52 imparts adequate stiffness to bodies 52, even if these bodies are of considerable size and are necessarily fabricated of thin steel plate material.

Additional, fixed diaphragms 66 are arranged and firmly secured inside vessel 10 and extend over its full height. According to this particular arrangement, a succession of chambers is formed inside the vessel, said chambers being hydraulically connected to each other through openings 68 in the top part of the single diaphragms 66; these openings 68 permit passage of the collar formed by the folded edges 56 and 57 of hollow bodies 52.

Rotor B is caused to rotate at a suitable speed by a motor D secured by means of plate 70 to the top part of vessel 10. The motor is hydraulic and advantageously drives rotor B by means of a pinion 72, chain 74 and crown wheel 75.

The first hydraulic loop of the exchanger takes one liquid to be treated in the case of the preferred embodiment sludge, waste water, etc. from a duct 76 in end wall 12 and feeds it into vessel 10. The opposite end wall 14 is provided with an elbow shaped discharge duct 78 leading into an overflow vessel or weir 80 provided with a bottom drain 82.

The diameter of these ducts is related to the nature and flow rate of the fluid under treatment, which, as stated above, may be sludge or waste water.

The arrangement described permits liquid flow from inlet to outlet practically without obstructions, especially in its flow through the chambers formed by diaphragms 66. The bottom part of these diaphragms, may be provided, if necessary, with flow orifices or ports.

The second hydraulic loop of the heat exchanger operates in counter current with the first. The second liquid enters from detachable fitting 40; after flowing through the first collecting chamber $C_4$ the liquid flows in succession through chambers $C_1$, $C_2$, $C_3$ of all the bodies 52 to collect finally, in the other chamber $C_4$ and discharge through port 38.

The objects of the invention are thus fully conformed i.e. heat recovery from residual liquids in general which may also come in the form of sludge; moreover, the heat exchanger surfaces of rotor B are continually renewed with respect to the circulating liquid in vessel 10, thus ensuring constant heat exchange and, consequently, optimum thermal efficiency.

It is likewise confirmed that scale formed on the heat exchanger's metal surfaces is easily removable both from shell A and from rotor B, as the rotor B can be disassembled from the shell via latches 50 and related screws 25 which secure supports 18 to walls 12 and 14 of vessel 10, since the surfaces at which ends 32, 34 of shaft 36 and those of gudgeons 24 and 26 meet coincide with the faces of flanges 28 and 30. All outer surfaces of the exchanger are thus made accesible to the cleaning media (water jets, brushes, etc.) and in particular the internal surfaces of vessel 10. Once cover 84 and rotor B are removed from the vessel 10, the vessel 10 can be conveniently overturned on gudgeons 24 and 26. If necessary, diaphragms 66 can also be removed, in case they are secured to the walls of vessel 10, for example, by fitting said walls with guides to hold the diaphragms 66 slidably.

It will be clear to those skilled in the art that various modifications and changes may be introduced, depending on particular application requirements, without departing from the spirit and scope of this invention.

What is claimed is:

1. A heat exchanger, comprising:

a shell;

a hollow rotor rotatably housed in said shell; said rotor having a longitudinal axis about which it is rotatable; said rotor being adapted to conduct heat between its interior and its exterior; said shell being adapted to have a first fluid flow therethrough in thermal contact with said rotor, and said rotor being adapted to have a second fluid flow longitudinally therethrough to effect heat exchange between the first and second fluids; the interior of said rotor being hydraulically sealed from the remainder of the interior of said shell; said rotor comprising a plurality of hollow bodies whose interiors communicate with each other; each said hollow body containing a diaphragm for regulating the flow of a fluid therethrough; each said hollow body cooperating with said diaphragm located therein to define a constricted region to divide said hollow body into a plurality of communicating chambers for regulating the flow of a fluid through said hollow body;

mounting means for rotatably mounting said rotor in said shell; and means for rotating said rotor, including said hollow bodies and said diaphragms.

2. The heat exchanger of claim 1, wherein said rotor comprises a shaft coaxial with said rotor and rotatably mounted in said shell by means of said mounting means for rotation about said axis.

3. The heat exchanger of claim 2, wherein said shaft has first and second ends and wherein said first and second ends of said shaft are hollow, the interiors of said shaft ends communicating with the interiors of said hollow bodies.

4. The heat exchanger of claim 3, wherein said hollow bodies, are secured to said shaft.

5. The heat exchanger of claim 4, wherein said rotor further comprises first and second hollow caps coaxial with and secured to said shaft, each of said caps being hollow and communicating directly with the interior of a respective one of said hollow bodies; the ends of said shaft, including the portions of said shaft to which said caps are secured, being hollow and the interior of said hollow ends of said shaft communicating by means of radial apertures formed therein with the interior of said hollow caps.

6. The heat exchanger of claim 3, wherein said hollow bodies are mounted on said shaft in a row, each of said hollow bodies communicating directly with adjacent said hollow bodies via a region of each hollow body adjacent said shaft.

7. The heat exchanger of claim 6, wherein said hollow bodies are lenticular.

8. The heat exchanger of claim 2, further comprising a plurality of first annular diaphragms, each of said first annular diaphragms being secured to said shaft at a point intermediate between two adjacent ones of said hollow bodies; each of said first annular diaphragms having perforations formed therein to allow adjacent said hollow bodies to communicate with each other.

9. The heat exchanger of claim 2, wherein said diaphragms are secured in a fluid tight manner to said shaft; each of said hollow bodies being coaxial with said shaft and having a respective plane of symmetry perpendicular to said axis, each of said second annular diaphragms being disposed in said plane of symmetry of a respective one of said hollow bodies.

10. The heat exchanger of claim 9, wherein said first and second annular diaphragms provide structural support for said lenticular hollow bodies.

11. The heat exchanger of claim 9, wherein each of said hollow bodies has a plurality of indentations formed therein at selected locations, each of said indentations abutting the respective said second annular diaphragm located in said hollow body, said respective second annular diaphragm and said indentations dividing said hollow body into said communicating chambers.

12. The heat exchanger of claim 1, wherein said shell and said rotor are adapted to have the first and second fluids flow therethrough in opposite directions.

13. The heat exchanger of claim 1, wherein said rotor has a length no greater than the length of the interior of said shell, whereby said rotor can be easily removed from said shell.

14. The heat exchanger of claim 1, wherein said mounting means comprises first and second gudgeons each secured to a respective end of said shell, said gudgeons being hollow to permit the flow therethrough of the second fluid.

15. The heat exchanger of claim 14, wherein said mounting means further comprises first and second supports removably secured to the interior of said ends of said shell; said gudgeons being secured to said shell by means of being secured to respective ones of said supports and said rotor being supported between said supports.

16. The heat exchanger of claim 15, wherein said mounting means comprises sealing flanges secured to respective ones of said ends of said shell; said supports being secured to said shell by means of being secured to said dealing flanges.

17. The heat exchanger of claim 15, wherein said supports comprise rotating seals.

18. The heat exchanger of claim 14, further comprising means located outside said shell and receiving said gudgeons and cooperating therewith to permit rotation of said shell to a selected orientation.

19. The heat exchanger of claim 1, wherein said shell contains a plurality of fixed diaphragms secured to said shell, each said fixed diaphragm being disposed between a respective pair of said hollow bodies.

20. The heat exchanger of claim 19, wherein each said fixed diaphragm has first and second opposite edges and is secured at said first edge of said shell and has a slot formed in said second edge of removably receiving said rotor.

21. The heat exchanger of claim 1, wherein each said hollow body has a radially inner portion and a radially outer portion and wherein said plurality of chambers into which each said hollow body is divided include a radially inner chamber and a radially outer chamber.

22. The heat exchanger of claim 21, wherein said plurality of chambers into which each said hollow body is divided further includes a third chamber.

* * * * *